United States Patent [19]

Langieri

[11] 4,189,150

[45] Feb. 19, 1980

[54] PINBALL GAME WITH LONGITUDINALLY MOVING FLIPPER CONTROLS

[75] Inventor: Michael Langieri, Butler, N.J.

[73] Assignee: Louis Marx & Co., Inc., Stamford, Conn.

[21] Appl. No.: 767,430

[22] Filed: Feb. 10, 1977

[51] Int. Cl.[2] ..... A63F 7/00

[52] U.S. Cl. ..... 273/121 A; 273/129 GA; 273/129 HB; 273/DIG. 26

[58] Field of Search ..... 273/121 R, 121 A, 119 R, 273/119 A, 122 R, 122 A, 129 GA, 129 GB, 129 R, 129 HA, 129 HB, 85 C, 85 D, 85 E

[56] References Cited

U.S. PATENT DOCUMENTS

| | | | |
|---|---|---|---|
| 1,213,628 | 1/1917 | Gumaer | 273/129 GA |
| 1,598,214 | 8/1926 | Milewski | 273/119 R |
| 1,919,094 | 7/1933 | Cuchran | 273/129 GA |
| 2,191,209 | 2/1940 | Hooker | 273/121 A |
| 2,230,950 | 2/1941 | Hough | 273/121 R |
| 2,905,468 | 9/1959 | Ellman | 124/27 X |
| 3,870,307 | 3/1975 | Meyer et al. | 273/121 A |
| 3,888,483 | 6/1975 | Adickes et al. | 273/129 HA |

FOREIGN PATENT DOCUMENTS

| | | | |
|---|---|---|---|
| 821908 | 9/1937 | France | 273/119 |
| 1154600 | 11/1937 | France | 273/121 A |
| 646265 | 9/1962 | Italy | 273/121 R |
| 194234 | 3/1923 | United Kingdom | 273/119 R |
| 507500 | 6/1939 | United Kingdom | 273/85 E |
| 864998 | 4/1961 | United Kingdom | 273/85 E |

OTHER PUBLICATIONS

Advertisement from Marx Catalog, p. 30.

*Primary Examiner*—Richard C. Pinkham
*Assistant Examiner*—Lawrence E. Anderson
*Attorney, Agent, or Firm*—Blum, Kaplan, Freidman, Silberman & Beran

[57] ABSTRACT

A pinball game is provided having two pairs of flippers, each pair being coordinately actuated by the pulling of a springbiased lever toward the user. A spring-loaded ball projecting mechanism is provided operatively coupled by a ratchet to a ball counting device. The ball projecting mechanism is released by displacement of a lever to project the ball and index the ball counting device.

18 Claims, 13 Drawing Figures

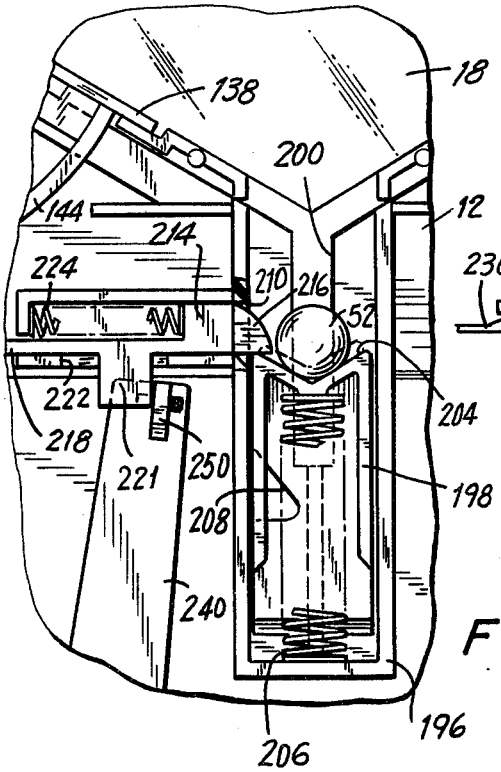
FIG. 7
FIG. 6
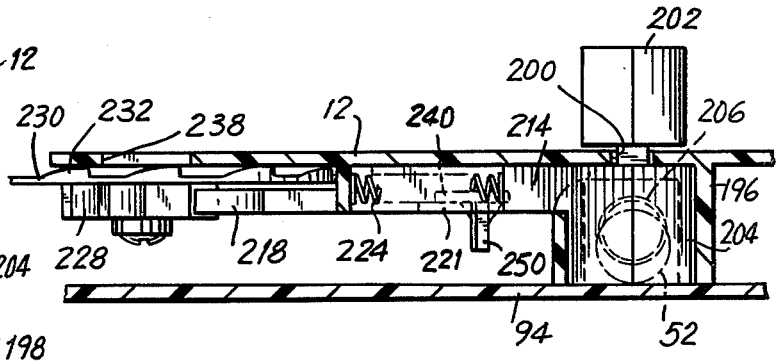
FIG. 8
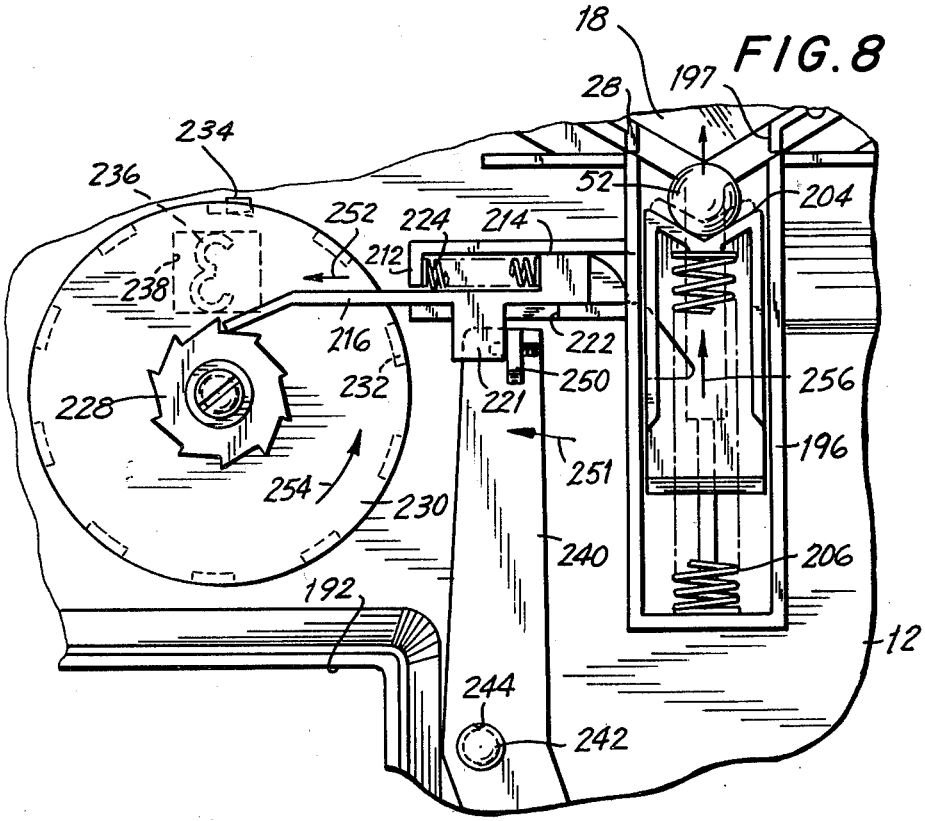

PINBALL GAME WITH LONGITUDINALLY MOVING FLIPPER CONTROLS

BACKGROUND OF THE INVENTION

This invention relates to pinball games, and in particular, to relatively inexpensive table-types thereof. Pinball machines are generally large devices powered by connection to the regular AC line and characterized by sophisticated electrical and mechanical structures for flipper-actuation, noise-generation and scoring, as well as ball handling. Such devices are both large and expensive and unsuitable for normal sale to the general public. A pinball game suitable for sale to the general public must be light in weight, inexpensive to manufacture, powered by no more than batteries and simple to operate. Further, it is desirous that such consumer-oriented pinball games provide a ball-counting capability as well as a scoring capability, and in addition, provide substantial play-value through manipulatable flippers and a reliable ball-projecting mechanism. By the arrangement in accordance with the invention, all of these features are provided.

SUMMARY OF THE INVENTION

Generally speaking, in accordance with the invention, a pinball game is provided having a housing, a portion of said housing defining a game field, flipper means pivotably mounted in said game field, and longitudinally displaceable flipper lever means mounted for displacement toward and away from the front edge of said housing, said flipper lever means being normally biased away from said front edge and operatively coupled to said flipper means for the operable displacement of said flipper means in response to the displacement of said flipper lever means toward said front edge.

The pinball game also includes a ball projecting means normally biased in a forwardly direction and adapted to receive a ball for projection across said game field. Said ball projecting means is manually displaceable against the spring bias to a cocked position and is selectively releasable by means of a release means. A ball counter mechanism is provided operatively coupled to said ball projecting means for indexing in response to the displacement thereof between the normal and cocked positions.

Battery-driven automatic scoring means is provided including solenoid means driving a pawl for indexing a ratchet, which in turn drives a scoring indicator. The game field is provided with a conductive surface and a plurality of conductive bumper means insulated from said conductive surface. Said solenoid is connected in series with battery means, said conductive bumpers and said conductive surface, whereby a conductive ball engaging said conductive surface and conductive bumpers closes the circuit to the solenoid to cause the indexing of said scoring mechanism. Bell means may be provided driven by said solenoid.

Accordingly, it is an object of this invention to provide a pinball game which is light in weight, relatively small in size and relatively inexpensive to manufacture yet provides substantial play value through provisions for automatic scoring and novel ball projecting and flipper actuating mechanisms.

Another object of the invention is to provide a pinball game wherein the flipper means are actuated by longitudinally displaceable levers.

A further object of the invention is to provide a pinball game which is portable and provides battery-powered automatic scoring and sound effects.

Still other objects and advantages of the invention will in part be obvious and will in part be apparent from the specification and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 3, 4, 5 and 6 are fragmentary sectional views taken along lines 3—3, 4—4, 5—5 and 6—6 respectively of FIG. 2;

FIG. 7 is a fragmentary bottom plan view of the ball projecting mechanism in accordance with the invention in a cocked position;

FIG. 8 is a fragmentary bottom plan view of the ball projecting mechanism and ball counter mechanism after release thereof from the cocked position;

DESCRIPTION OF THE PREFERRED EMBODIMENT

Figure 13:
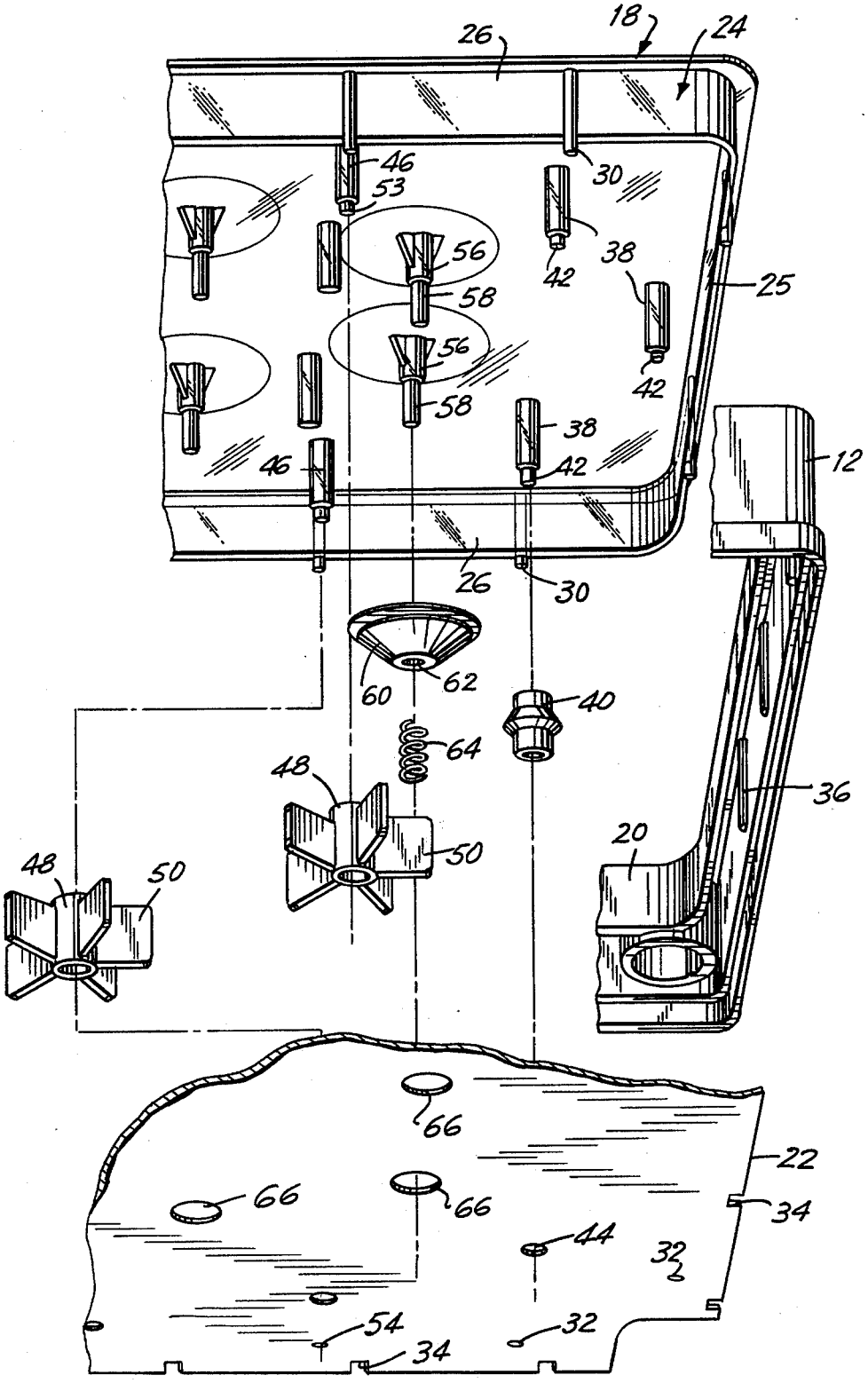
FIG. 13 is an exploded view of the game field in accordance with the invention.

Referring now to the drawings, the pinball game 10 depicted is provided with a housing 12 supported at an incline by a pair of legs 14 mounted adjacent the rearward edge thereof. Approximately the rearward two-thirds of the housing defines a game field 16 provided with a transparent cover 18 received in a correspondingly shaped aperture 20 in housing 12. The floor of game field 16 is defined by a conductive plate 22. The side walls of game field 16 are defined by depending peripheral walls 24 of cover 18, said walls defining a rear wall 25, side walls 26 and substantially V-shaped front walls 28. A plurality of pegs 30 project from walls 24 and are received in corresponding apertures 32 in conductive plate 22 to insure proper alignment between the cover 18 and conductive plate 22. Conductive plate 22 is also provided with a plurality of peripheral notches 34 for receipt of vertically extending ribs 36 in housing 12 (FIG. 13) to insure proper positioning of the conductive plate relative to the housing. Cover 18, conductive plate 22 and housing 12 are joined together in a conventional manner through the use of screws or the like (not shown).

Figure 10:
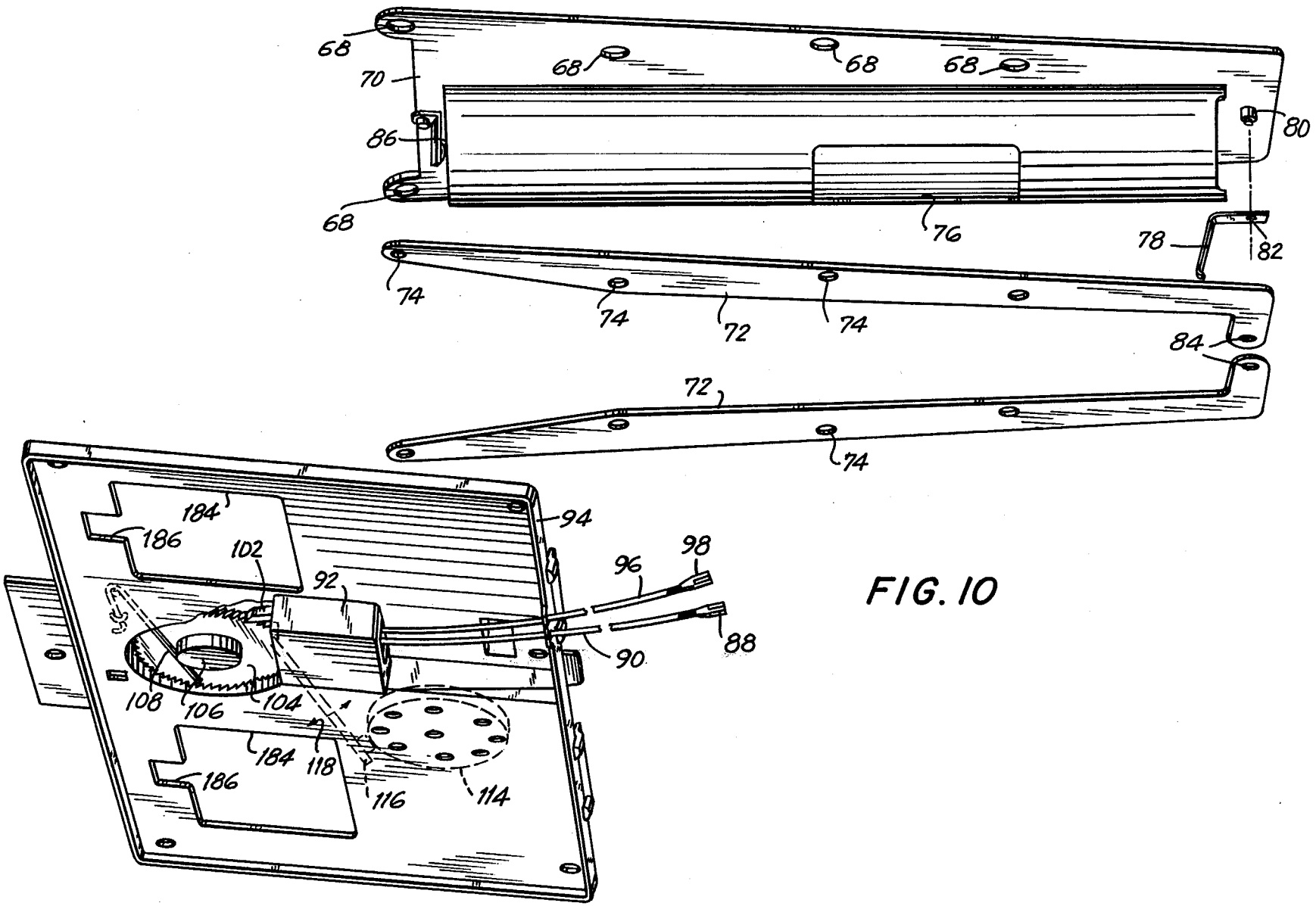
FIG. 10 is an exploded view of the battery holder and automatic scoring mechanism in accordance with the invention.
Figure 11:
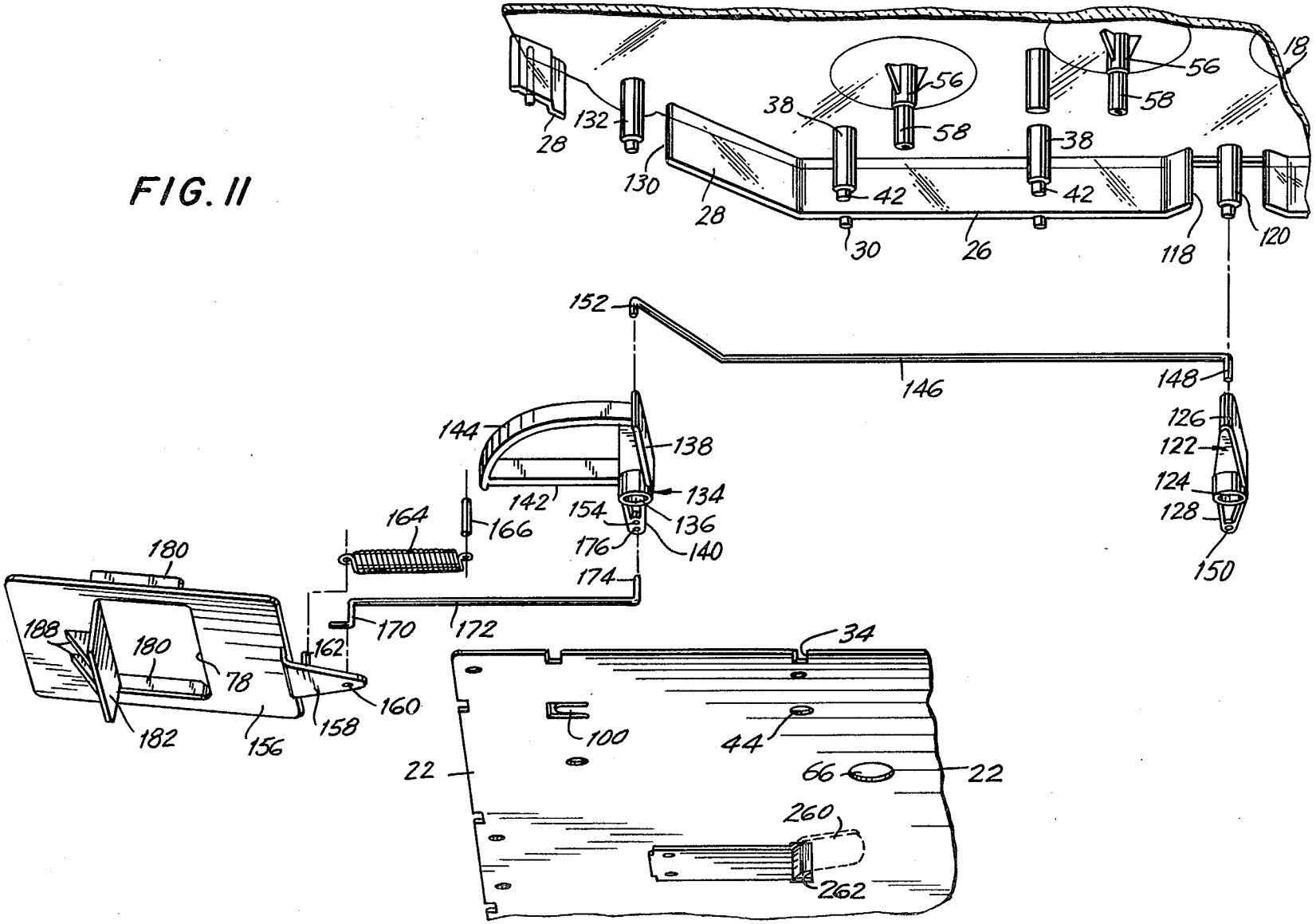
FIG. 11 is an exploded fragmentary view of the flipper actuating mechanism in accordance with the invention.

Game field 16 is provided with a plurality of obstacles to enhance the play value of the pinball game. Specifically, cover 18 is formed with a plurality of downwardly projecting posts 38, each of which supports a bumper 40, said bumper being retained in position by conductive plate 22, each of posts 38 being provided with pegs 42 at the ends thereof for receipt in corresponding apertures 44 in conductive plate 22. A pair of further posts 46 depending from cover 18 support freely rotatable spinners 48 provided with five radially extending fins 50 for engagement by the ball 52. Further posts 46 are likewise provided with pegs 53 at the ends thereof for engagement in corresponding apertures 54 in conductive plate 22. A third type of obstacle is supported by a plurality of still further posts 56 depending from cover 18 and formed with an elongated region of lesser diameter 58 at the end thereof. Still further posts 56 support scoring bumpers formed from a conductive cone member 60 in the shape of a truncated cone, the broad base of which rests against the top wall of cover 18 and the bottom of which is formed with an axial aperture 62 dimensioned to permit portion 58 of post 56 to pass therethrough. A compression spring 64 also extends around projecting portion 58 of post 56 and is in conductive engagement with conductive cone member 60. Both projecting portion 58 of post 56 and compression spring 64 pass through enlarged apertures 66 in conductive plate 22 without making electrical connection therewith. Rather, projecting portion 58 of post 56 and compression spring 64 pass through corresponding enlarged apertures 68 in a battery holder member 70 mounted to the underside of conductive plate 22. A pair of conductive strips 72 are mounted on battery holder 70 and formed with apertures 74 therethrough of reduced diameter relative to aperture 68, apertures 74 being dimensioned to receive the ends of projecting portions 58 of posts 56 to insure proper registration of the assembly. By this arrangement, compression springs 64 are compressed between conductive strips 72 and conductive cone members 60 to provide electrical connections therebetween. Battery holder 70 is adapted to receive a plurality of conventional battery cells which may be inserted through an aperture in said battery holder covered by a displaceable cover 76. The batteries are connected in series within battery holder 70 with one end of said series connection engaging a battery terminal 78 mounted on a post 80 projecting from battery holder 70 by means of an aperture 82 in said battery terminal 78. Conductive strips 72 are connected electrically to battery terminal 78 by likewise being mounted on post 80 through apertures 84 and held in place by a conventional lock washer (not shown). The other end of the series connection of the batteries within battery holder 70 are connected to a second battery terminal 86 provided with a conventional tab connector for connection to the terminal end 88 of wire 90, which is connected to a solenoid 92 supported on a bottom plate 94. Electrical connection between solenoid 92 and conductive plate 22 is provided by wire 96, the terminal end 98 of which engages a conventional tab connector 100 is conductive plate 22 (FIGS. 10 and 11). Bottom plate 94 would be mounted on housing 12 by screws or the like (not shown) in a conventional manner.

Figure 3:
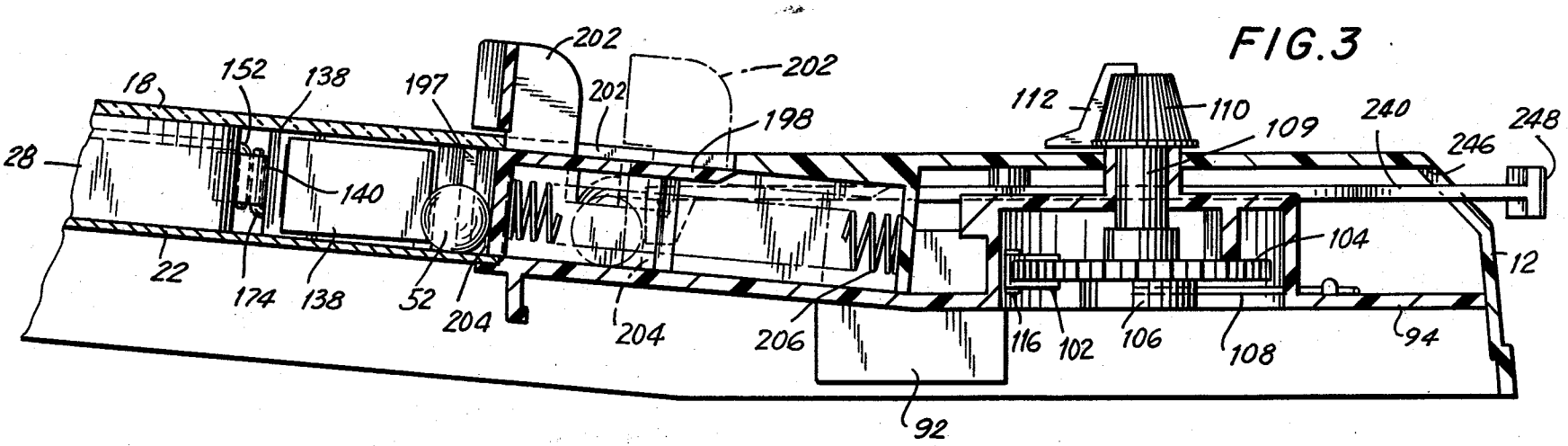
Figure 4:
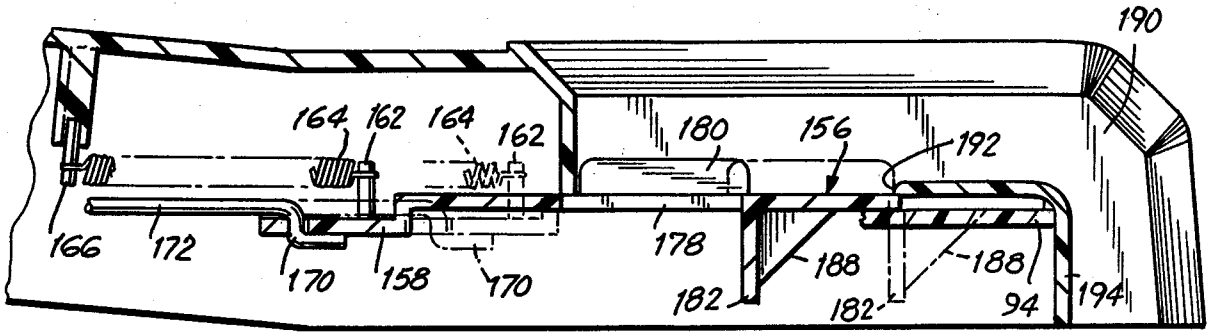
Figure 5:
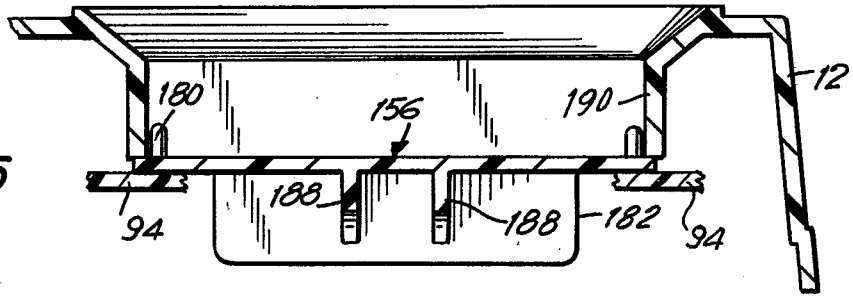

The foregoing electrical connection provides an automatic scoring mechanism. Specifically, ball 52 is formed of a conductive material and when said ball strikes a conductive cone member 60 of the scoring bumpers, electrical connection is made between said conductive cone member and the conductive plate through the conductive ball. This closes the circuit to solenoid 92, causing the pawl 102 driven thereby to be displayed against the teeth of ratchet wheel 104 to index said ratchet wheel by one. Ratchet wheel 104 is provided with a cylindrical brake portion 106 engaged by a brake spring 108 mounted on bottom plate 94 to insure that ratchet wheel 104 indexes by only one and remains in position between indexing. Ratchet wheel 104 is coupled through a shaft 109 (FIG. 3) to a scoring knob 110 on the upper surface of housing 12. Scoring knob 110 is provided with a projecting indicator 112 which cooperates with a scoring scale 114 to provide a visual indication of the points scored. The scoring ratchet may be manually reset to zero by the manual manipulation of scoring knob 110. In order to further enhance the play value of the pinball game in accordance with the invention, a bell 114 is mounted on cover plate 194 for actuation by a hammer 116 displaced in the direction of arrows 118 in coordination with each displacement of pawl 102 by solenoid 92. In other words, upon each engagement of the ball with a scoring bumper defined by conductive cone members 60, the scoring ratchet 104 is indexed by one and a bell 114 is struck, all of these operations occurring automatically through the battery power provided.

As more particularly shown in FIG. 11, side walls 26 are each formed with a gap 118 therein, a post 120 projecting from cover 18 being positioned in each gap 118. An upper flipper 122 is pivotably mounted by means of bore 124 on post 120 with flipper arm 126 projecting into game field 16 and pivot arm 128 projecting into gap 118. The V-shaped front wall 28 is provided with a pair of gaps 130, in each of which a post 132 projects downwardly from cover 18. A lower flipper 134 is pivotably mounted on each post 132 by means of bore 136. Each lower flipper is provided with a flipper arm 138 which projects into the game field, a pivot arm 140 which projects into the gap 130, a straight support arm 142 projecting into housing 18 and an arcuate support arm 144 bridging the ends of support arm 142 and flipper arm 138. Upper flipper 122 and lower flipper 134 are operatively coupled by flipper connector wire 146 formed with a bent projecting upper end 148 which is received in aperture 150 in lever arm 128 of upper flipper 122 and a bent projecting lower end 152 received in aperture 154 in lever arm 140 of lower flipper 134. The connected flippers 122, 134 are coordinately driven by a longitudinally displaceable flipper lever 156 supported between bottom cover 94 and housing 12. Flipper lever 156 is provided with a forwardly projecting tab 158 formed with aperture 160 therein for receipt of the bent projecting lower end 170 of flipper driver wire 172, the bent projecting upper end 174 of said flipper driver wire being received in aperture 176 in lever arm 140 of lower flipper 134. Tab 158 is also provided with a projecting pin 162 for engagement with one end of biasing spring 164, the other end of said biasing spring engaging pin 166 mounted on housing 12 as more particularly shown in FIG. 2, wherein flipper lever 156 and lower flipper 134 are depicted in solid lines in their rest position, and in dashed lines in their actuated position wherein flipper lever 156 is longitudinally displaced towards the front edge of housing 18. Flipper lever 156 is formed with a central, substantially rectangular opening 178. Projecting upwardly on either side of opening 178 are a pair of guide walls 180 while a downwardly projecting pushing wall 182 extends across the rear edge of opening 178. Bottom cover 94 is provided with a pair of substantially rectangular openings 184 dimensioned for registration with opening 178 on flipper level 176 is at its rest position and at its fully displaced position. The forward edge of opening 184 in bottom cover 94 is formed with a substantially rectangular cut-out region 186 to accommodate supporting walls 188 which extend laterally from and provide structural support for pushing wall 182.

Figures 1, 9:
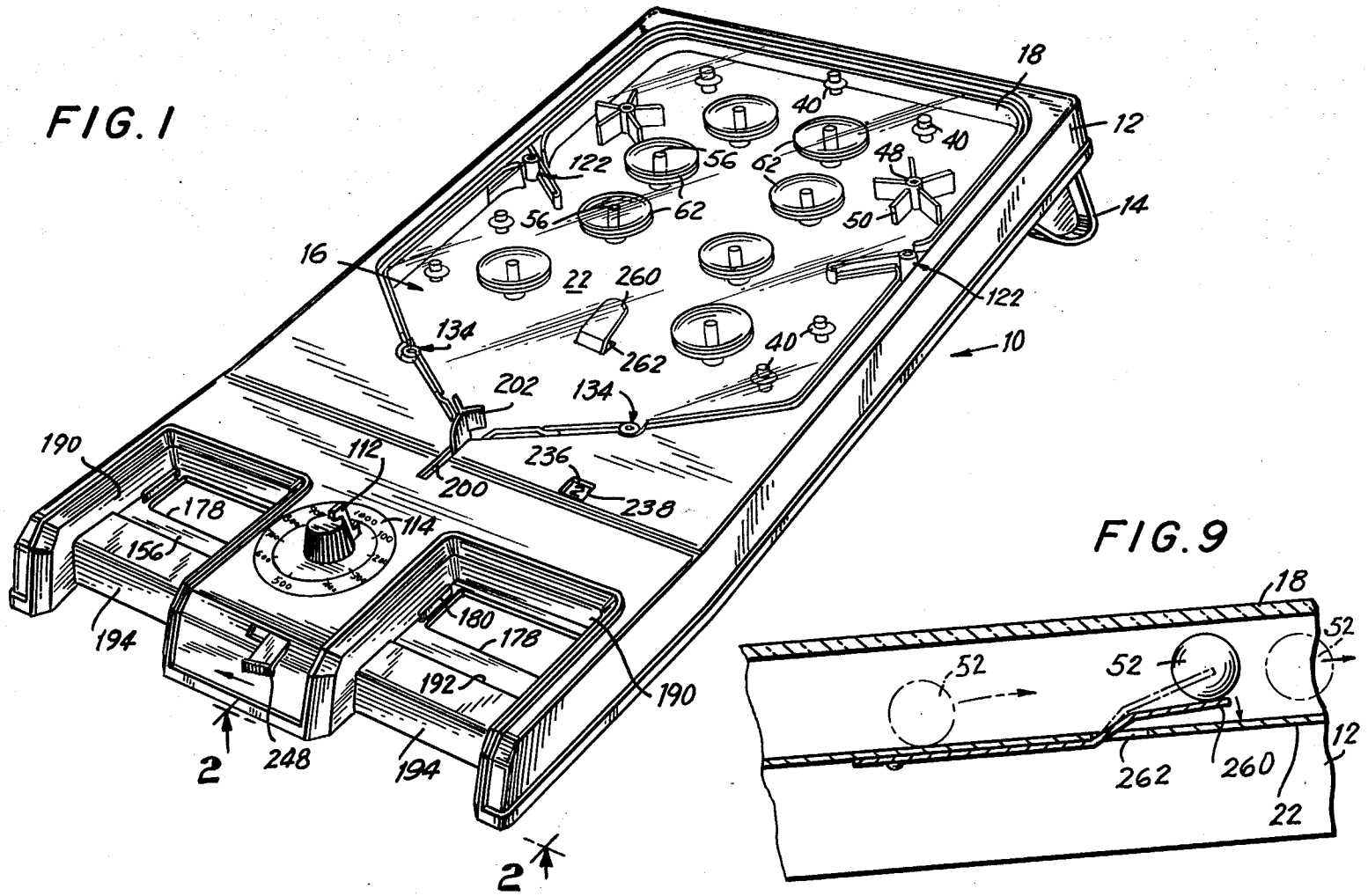
FIG. 1 is a perspective view of the pinball game in accordance with the invention.
FIG. 9 is a fragmentary sectional view of the reflector spring mounted on the game field.
Figure 2:
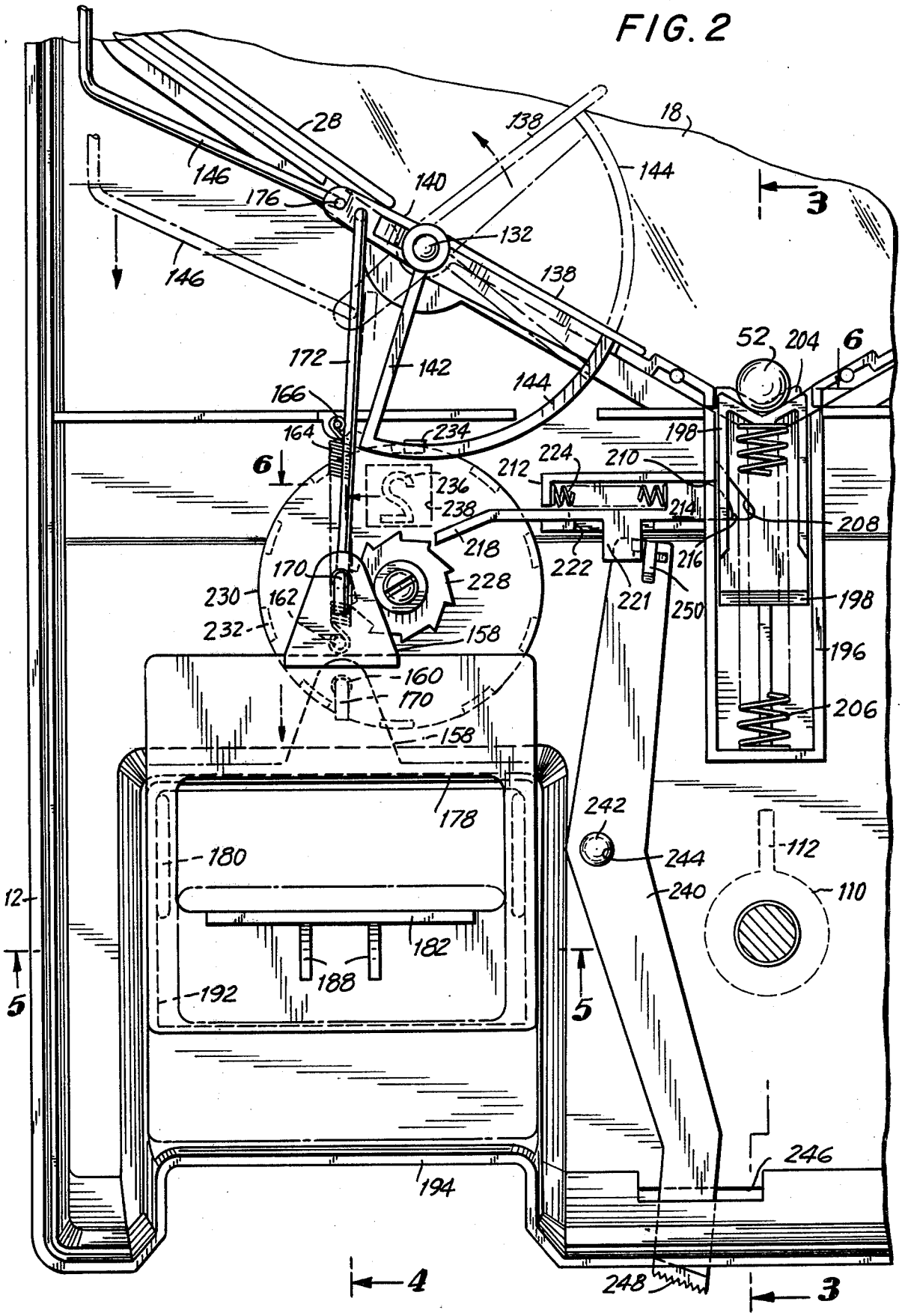
FIG. 2 is a fragmentary bottom view with the bottom cover removed of the pinball game in accordance with the invention depicting the flipper actuation mechanism, ball projecting mechanism and ball counter mechanism.
Figure 12:
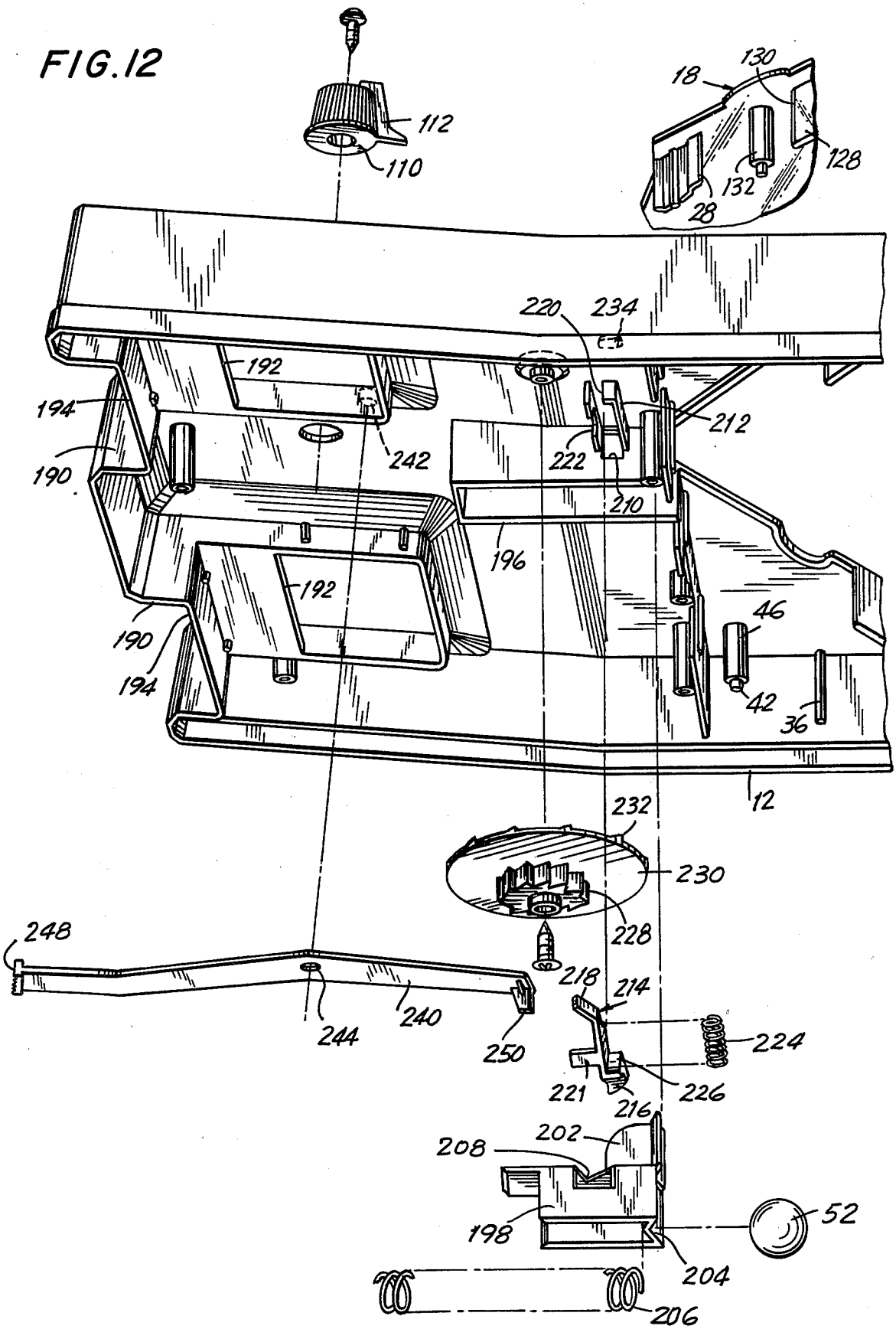
FIG. 12 is an exploded view of the ball projecting mechanism in accordance with the invention.

As more particularly shown in FIGS. 1, 2 and 12, housing 12 is formed with a pair of cut-out regions 190 which are recessed in from the forward edge and from the top surface of housing 12 to define wells. Said wells are provided with an opening 192 therethrough providing access to the corresponding flipper levers 156, guide walls 180 projecting upwardly into wells 190 to guide the longitudinal displacement of said flipper members toward and away from the front edge of housing 12. The foregoing construction provides an advantageous arrangement for operating flippers in that the user can place the heel of his hand against the respective front walls 194 of wells 190 and place for fingers through opening 192 in cover 12, opening 178 in flipper level 156 and opening 184 in bottom cover 94 and place said fingers against pushing wall 182 of said flipper lever. In this manner, actuation of the flippers is made by a simple squeezing motion of the fingers toward the heel of the hand leaving the thumb free to actuate the ball projecting lever as will be more particularly described below.

Turning now to FIGS. 2–4 and 6–8, the ball projecting mechanism in accordance with the invention will be described. Housing 12 is formed with a trough 196 positioned at the apex of V-shaped front wall 28, which is formed with a gap 197 in registration with the open upper end of said trough. Cover 12 is formed with a longitudinally extending slot 200 positioned in registration with trough 196 and extending along approximately one-half the length of said trough from the open end thereof. Riding within trough 196 is a ball projecting member 198 formed with an upwardly projecting manipulating portion 202 which projects through slot 200 to a position above housing 12 to permit the manual displacement of the ball projecting member 198. The forward end of ball projecting member 198 is formed in a V-shaped ball receiving pocket 204 against which the ball is normally directed due to the incline of game field 16 and the V-shaped front wall 28. Ball projecting member 198 is hollow and has an open rear end. A spring 206 is received within ball projecting member 198 extending between the rear wall of trough 196 and the rear of V-shaped end wall 204 of the ball projecting member. Ball projecting member 198 is formed with a notch 208 in a side wall thereof, the adjacent side wall of trough 196 being formed with an opening 210 therethrough communicating with smaller guide trough 212 extending laterally to trough 196. Mounted for slidably displacement within guide trough 212 is a counter pawl 214 having a first finger 216 which projects through opening 210 in trough 196 and a second finger 218 which projects through opening 220 in the end wall of guide trough 212. Further, counter pawl 214 is provided with a forwardly projecting finger 221 which extends through a notch 222 in the forward wall of trough 212, said notch being of a width sufficient to permit the axial displacement of counter pawl 214 in guide trough 212. Counter pawl 214 is normally biased through opening 210 by a spring 224 mounted in trough 212 between the end wall thereof and a lateral wall 226 in said counter pawl. Second finger 218 engages the teeth of a ratchet wheel 228 provided with ten teeth. Ratchet wheel 228 is mounted on a disc 230 which is, itself, formed with ten upwardly projecting inclined teeth 232 which cooperate with a downwardly projecting inclined tooth 234 formed in housing 12 to provide positive indexing for ratchet wheel 228. Disc 230 carries five numbers 236 on an upper surface thereof positioned to be in registration with an opening 238 in the top surface of housing 12. Disc 239 provides a ball counter which is actuated as follows.

Referring first to FIG. 2, the ball projecting mechanism in accordance with the invention is depicted in the normal rest position at the end of the play of a ball. The single ball 52 is resting in the V-shaped pocket 204 of ball projecting member 198. Notch 208 in said ball projecting member is in registration with opening 210 in trough 196 and counter pawl 214 is displaced to the right as viewed in FIG. 2 into notch 208. A ball release lever 240 is pivotably mounted on pin 242 through a central aperture 244 therein. The forward end of ball release lever 240 projects through a slot 246 in the forward edge of housing 12 and terminates in a knurled flattened end 248 positioned for manipulation by the thumb of the right hand of the user of the game while the user is also manipulating flipper level 156. The rearward end of ball release lever 240 is provided with a downwardly projecting finger 250 which engages projecting finger 221 of counter pawl 214.

To cock ball projecting member 196, the manipulating portion 202 is grasped by the user and the ball projecting member is displaced forwardly to compress spring 206 until the position of FIG. 7 is reached. During such displacement, due to the shape of notch 208 and first finger 216 of counter pawl 214, said counter pawl is cammed and displaced to the left as viewed in FIG. 2 to cause second finger 218 to engage a tooth of ratchet wheel 228 to index said ratchet wheel by one, representing half of the displacement of a number.

FIG. 7 represents the cocked position of the ball projecting member, said ball projecting member being held in said cocked position by first finger 216 of counter pawl 214 which projects through opening 210 in trough 196 and is engaged by the end of ball engaging member 198. To release the ball projecting member 198 from the cocked position as shown in FIG. 7 to project the ball 52 on to game field 16, ball release lever 240 is displaced in the counter clockwise direction as viewed in FIGS. 2, 7 and 8 (direction of arrow 251) by the user, thereby displacing counter pawl 214 to the left as viewed in FIGS. 2, 7 and 8 (direction of arrow 252 in FIG. 8) so that first finger 216 engages a tooth of ratchet wheel 228 to index said ratchet wheel by another tooth in the direction of arrow 254, thereby completing the indexing of disc 230 to place the next number 236 in window 238. In addition, since counter pawl 214 is displaced out of the path of ball projecting member 198, said ball projecting member is displaced in the direction of arrow 256 (FIG. 8) due to the energy stored in spring 208 to hurl ball 52 on to the game field. When ball release lever 240 is released by the user, said lever and counter pawl 214 are returned to the position of FIG. 2 due to the action of spring 224.

The hurled ball passes over a deflecting spring 260 projecting into the game field from an aperture 262 in conductive plate 22 as shown in FIG. 9 to further enhance the randomness of the motion of the ball.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A pinball game comprising a housing having a front edge, said housing being formed to define a game field spaced from said front edge and with at least one opening in a top surface thereof spaced from said front edge and positioned intermediate said front edge and said game field; flipper means pivotably mounted in said game field; longitudinally displaceable flipper lever means mounted in said housing opening for displacement in said opening towards and away from the front edge of said housing; means operatively coupling said flipper means and flipper lever means for the operable displacement of said flipper means in response to the displacement of said flipper lever means toward said front edge; and means biasing said flipper lever means in a direction away from said front edge, said flipper lever means being formed with a user engaging surface positioned so that when said flipper lever means is biased in a rest position said user engaging surface is in registration with a portion of said housing opening spaced from said front edge and a user may operably manually displace said flipper lever means toward said front edge to actuate said flipper means by inserting fingers through said housing opening into engagement with said user engaging surface of said flipper lever means and pulling said flipper lever means toward said housing front edge, said flipper lever means being formed with an opening in a top surface thereof dimensioned in the direction of displacement of said flipper lever means so as to be narrower than said opening in said housing to define said user engaging surface.

2. A pinball game as recited in claim 1, wherein the spacing between said flipper lever means opening and said housing front edge is selected to enable the user to rest the heel of a hand against said front edge and to displace said flipper lever means by squeezing motion of the fingers of that hand.

3. A pinball game as claimed in claim 2, including a ball on said game field and ball projecting means for initially hurling said ball across said game field, said ball projecting means including release lever means positioned adjacent said front edge for actuation by the thumb of a hand of a user positioned for actuation of said flipper lever means.

4. A pinball game as claimed in claim 1, including two of said flipper means, two of said flipper lever means and means independently coupling each of said flipper lever means to one of said flipper means for independent actuation of said flipper means, said housing means being formed with two openings, one of said flipper lever means being displaceable in each of said housing means openings, said housing means openings being laterally spaced relative to the front edge of said housing.

5. A pinball game as claimed in claim 4, wherein each of said flipper means includes a pair of flippers spaced in the direction normal to said housing front edge, and means coupling the respective flippers of said flipper means for the coordinate displacement thereof, one of said flipper means being positioned on each side of said game field.

6. A pinball game as recited in claim 1, including ball projecting means mounted on one edge of said game field, said game including a ball, said ball projecting means including pocket means for receiving said ball, means for biasing said pocket means to a rest position, said pocket means being mounted for manually longitudinal displacement from said rest position to a cocked position, means for retaining said pocket means at said cocked position and ball release means for selectively manually releasing said retaining means, whereby said ball is hurled across said playing field by the displacement of said pocket means from the cocked position to the rest position by the bias means.

7. A pinball game as claimed in claim 6, including ball counter means operatively coupled to said ball projecting means for providing a visual count of the number of balls played and adapted for indexing by one in response to each cycle of actuation of said ball projecting means.

8. A pinball game as claimed in claim 7, including a counter lever displaceable laterally to the path of displacement of said pocket means and biased toward said pocket means, said counter lever engaging said pocket means to hold said pocket means in its cocked position, said pocket means being formed with camming surfaces for displacing said counter lever during the displacement of said pocket means, said counter means including a ratchet wheel indexed in response to the displacement of said counter level.

9. A pinball game as claimed in claim 8, wherein said ball release means includes a ball release lever pivotably mounted on said housing, one end of said ball release lever extending outside of said housing for manual manipulation, the other end of said ball release lever being positioned for engagement with said counter lever for the manual displacement of said counter lever from its position at which it holds said pocket means in its cocked position to coordinately release said pocket means to hurl said ball across said game field and to index said ratchet wheel.

10. A pinball game as claimed in claim 9, including a number identifying means mounted on said ratchet wheel capable of identifying n numbers, said ratchet wheel having 2n teeth, said counter lever being displaceable by said socket means when said socket means is manually displaced from its rest to its cocked position to advance said ratchet wheel by one tooth, the actuation of said ball release lever causing the indexing of said ratchet wheel a second tooth to thereby render the next number visually identifiable to the user of the game.

11. A pinball game as claimed in claim 6, wherein said game field is inclined to the horizontal toward said rest position of said pocket means, said game including a single ball automatically returned to said pocket means by said inclined game board.

12. A pinball game as claimed in claim 1, including a ball, bumper means in said game field, means for detecting engagement of said ball against said bumper means, and scoring means for automatically providing a visual indication of the number of engagements of said ball against said bumper means in response to said detection means.

13. A pinball game as claimed in claim 12, wherein said game field is formed with a conductive floor, said bumper means including a conductive bumper element insulated from said conductive floor and of a height for engagement by said ball, said ball being formed of a conductive material, said detection means detecting the closing of an electrical path by the engagement of said ball with said conductive floor and conductive bumper element.

14. A pinball game as claimed in claim 13, wherein said detection means includes solenoid means actuated by the closing of said electrical path by said ball, pawl means displaced by the actuation of said solenoid means and ratchet means rotatably displaced by the actuation of said pawl means for providing a visual indication of score.

15. A pinball game as claimed in claim 14, including bell means, means actuable in response to actuation of said solenoid means to actuate said bell in response to the engagement of said ball with said conductive floor and conductive bumper element.

16. A pinball game comprising a housing having a front edge, said housing being formed to define a game field spaced from said front edge; flipper means pivotably mounted in said game field; longitudinally displaceable flipper lever means mounted in said housing intermediate said game field and front edge for displacement toward and away from the front edge of said housing; means operatively coupling said flipper means and flipper lever means for the operable displacement of said flipper means in response to the displacement of said flipper lever means towards said front edge; means biasing said flipper lever means in a direction away from said front edge; ball projecting means mounted on one edge of said game field, said game including a ball, said ball projecting means including pocket means for receiving said ball; means for biasing said pocket means to a rest position, said pocket means being mounted for manual longitudinal displacement from said rest position to a cocked position; means for retaining said pocket means at said cocked position; ball release means for selectively manually releasing said retaining means, whereby said ball is hurled across said playing field by the displacement of said pocket means from the cocked position to the rest position by the bias means; ball counter means operatively coupled to said ball projecting means for providing a visual count of the number of balls played and adapted for indexing by one in response to each cycle of actuation of said ball projecting means; and a counter lever displaceable laterally to the path of displacement of said pocket means and biased toward said pocket means, said counter lever engaging said pocket means to hold said pocket means in its cocked position, said pocket means being formed with camming surfaces for displacing said counter lever during the displacement of said pocket means, said counter means including a ratchet wheel indexed in response to the displacement of said counter lever.

17. A pinball game as claimed in claim 16, wherein said ball release means includes a ball release lever pivotably mounted on said housing, one end of said ball release lever extending outside of said housing for manual manipulation, the other end of said ball release lever being positioned for engagement with said counter lever for the manual displacement of said counter lever from its position at which it holds said pocket means in its cocked position to coordinately release said pocket means to hurl said ball across said game field and to index said ratchet wheel.

18. A pinball game as claimed in claim 17, including a number identifying means mounted on said ratchet wheel capable of identifying n numbers, said ratchet wheel having 2n teeth, said counter lever being displaceable by said socket means when said socket means is manually displaced from its rest to its cocked position to advance said ratchet wheel by one tooth, the actuation of said ball release lever causing the indexing of said ratchet wheel a second tooth to thereby render the next number visually identifiable to the user of the game.

* * * * *